US008091980B2

(12) United States Patent
Snyder et al.

(10) Patent No.: US 8,091,980 B2
(45) Date of Patent: Jan. 10, 2012

(54) EXTERNAL PARTICLE MITIGATION WITHOUT EXCEEDING DROOLING LIMITATIONS

(75) Inventors: Trevor James Snyder, Newberg, OR (US); James Matthew Cunnington, Tualatin, OR (US); Rodney Bryant Hill, Mt. Angel, OR (US); Kathleen M. Faraci, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 372 days.

(21) Appl. No.: 12/431,411

(22) Filed: Apr. 28, 2009

(65) Prior Publication Data

US 2010/0271423 A1 Oct. 28, 2010

(51) Int. Cl.
*B41J 2/165* (2006.01)

(52) U.S. Cl. ..... 347/35; 347/33

(58) Field of Classification Search ..... 342/33
See application file for complete search history.

(56) References Cited

U.S. PATENT DOCUMENTS

| | | | | |
|---|---|---|---|---|
| 6,913,338 | B2 | 7/2005 | Rhoads et al. | |
| 7,111,917 | B2 | 9/2006 | Hill et al. | |
| 2005/0146545 | A1* | 7/2005 | Richards | 347/14 |
| 2005/0146572 | A1* | 7/2005 | Hill et al. | 347/85 |
| 2006/0268050 | A1* | 11/2006 | Sonobe | 347/29 |
| 2007/0126783 | A1* | 6/2007 | Deshon-Stepp et al. | 347/33 |

* cited by examiner

*Primary Examiner* — Mark Robinson
*Assistant Examiner* — Andrew Jordan
(74) *Attorney, Agent, or Firm* — Maginot, Moore & Beck, LLP

(57) ABSTRACT

A method of performing maintenance on a printhead of an imaging device includes the application of a purge pressure to ink in an on-board reservoir of the printhead to cause ink to be burped through a plurality of apertures in an aperture plate of the printhead. A wiper blade is then dabbed on the aperture plate at least once after the application of the purge pressure. After the dabbing, the wiper blade is drawn across the aperture plate. The wiper blade is then dabbed against the dabbing position at least once after wiping the aperture plate.

12 Claims, 8 Drawing Sheets

| | PURGE SEQUENCE | |
|---|---|---|
| | FIGS. 5A-5C | FIGS. 6A-6D |
| ASSIST PRESSURE | DEFLECTIVE JET RECOVERY | |
| 0 | -539% | -64% |
| 40 | -370% | -59% |
| 60 | -151% | -25% |
| 80 | -20% | -15% |
| 100 | 0% | 4% |

EXTERNAL PARTICLE MITIGATION WITHOUT EXCEEDING DROOLING LIMITATIONS

TECHNICAL FIELD

This disclosure relates generally to printheads of an ink jet imaging device, and, in particular, to maintenance methods for use with such printheads.

BACKGROUND

Solid ink or phase change ink printers conventionally receive ink in a solid form, sometimes referred to as solid ink sticks. The solid ink sticks are typically inserted through an insertion opening of an ink loader for the printer, and are moved by a feed mechanism and/or gravity toward a heater plate. The heater plate melts the solid ink impinging on the plate into a liquid that is delivered to a printhead assembly for jetting onto a recording medium. The recording medium is typically paper or a liquid layer supported by an intermediate imaging member, such as a metal drum or belt.

A printhead assembly of a phase change ink printer typically includes one or more printheads each having a plurality of ink jets from which drops of melted solid ink are ejected towards the recording medium. The ink jets of a printhead receive the melted ink from an ink supply chamber, or manifold, in the printhead which, in turn, receives ink from a source, such as a melted ink reservoir or an ink cartridge. Each ink jet includes a channel having one end connected to the ink supply manifold. The other end of the ink channel has an orifice, or nozzle, for ejecting drops of ink. The nozzles of the ink jets may be formed in an aperture, or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to each other, the deposited drops can be precisely patterned to form particular text and graphic images on the recording medium.

One difficulty faced by fluid ink jet systems is partially or completely blocked ink jets. Partially or completely blocked ink jets may be caused by any of a number of factors including contamination from dust or paper fibers, dried ink, etc. In addition, when the solid ink printer is turned off, the ink that remains in the print head can freeze. When the printer is turned back on and warms up, the ink thaws in the print head. Air that was once in solution in the ink can come out of solution to form air bubbles or air pockets that can become lodged in the ink pathways of the print head. Partially or completely blocked ink jets can lead to ink jet malfunctions or failures resulting in missing, undersized or misdirected drops on the recording media that degrade the print quality.

Some partially or completely blocked ink jets may be recovered by performing a printhead maintenance action. Print head maintenance generally includes purging ink through the ink pathways and nozzles of a print head assembly in order to clear contaminants, air bubbles, dried ink, etc. from the print head assembly and/or wiping the nozzle plate of the print head assembly. To prevent ink and debris from being drawn or pushed back into the printhead via the ink jets during wiping, a low pressure assist ("LPA") may be applied to the printhead during wiping. The assist pressure is applied to the printhead reservoir during wiping to prevent ink and debris from being sucked into the apertures. To maintain the ink at the apertures, the assist pressure must be sufficient to overcome any back pressure. If the assist pressure is too low ink and debris may be drawn into the apertures. If the assist pressure is too high the apertures may drool ink even after a wipe has been performed. Maintaining the ink at the apertures during a wiping procedure is made more difficult by a varying pressure introduced into the reservoir due to changes in the amount of ink in the reservoir, also referred to as head height. The assist pressure and the head height both serve to apply pressure to the apertures during the wipe. However, the pressure from the ink height is not constant since it changes as the ink level changes.

Surface wetting characteristics and/or internal pressure characteristics of the printhead cause ink to drool from the apertures at a some measurable LPA pressure. If the drool pressure of a printhead is lowered for whatever reason, the application of the normal assist pressure to the on-board reservoir may cause ink to drool from the apertures during wiping. Such drooling can negatively impact imaging operations by leaving ink on the aperture plate which may cause color mixing as well as further contamination of the apertures.

SUMMARY

Aperture contamination as well as changes to the surface characteristics of the aperture plate over time that may cause drooling may be minimized or prevented by insuring that the aperture plate and the wiper blade are cleared of debris particles prior to performing a wipe of the aperture plate during a purge cycle. In one embodiment, the present disclosure proposes a method of external particle mitigation that avoids exceeding drooling limitations and that involves the use of pre-burps, pre-dabs, and post-dabs to a purge sequence. In particular, a method of performing maintenance on a printhead of an imaging device includes the application of a purge pressure to ink in an on-board reservoir of the printhead to cause ink to be burped through a plurality of apertures in an aperture plate of the printhead. A wiper blade is then dabbed on the aperture plate at least once after the application of the purge pressure. After the dabbing, the wiper blade is drawn across the aperture plate. The wiper blade is then dabbed against the dabbing position at least once after wiping the aperture plate.

In another embodiment, a method of performing printhead maintenance uses a combination of high pressure purges and low pressure wipes or high pressure wipes followed by low pressure purges in order to maximize the pressure applied but still mitigate the impacts of drooling. In particular, one method of performing maintenance on a printhead of an imaging device includes wiping an aperture plate of a printhead with a wiper blade while applying a first assist pressure to ink in the printhead. After wiping the printhead, ink is purged through a plurality of apertures in the aperture plate of the printhead. Then, after purging the printhead, the aperture plate of the printhead is wiped with the wiper blade while applying a second assist pressure to the ink in the printhead. The second assist pressure is different than the first assist pressure. Another method of performing maintenance on a printhead of an imaging device includes applying a purge pressure to ink in a printhead to cause ink to be purged from a plurality of apertures in an aperture plate of the printhead. After purging the printhead, the aperture plate of the printhead is wiped with a wiper blade while applying a first assist pressure to the ink in the printhead. Then, after wiping the printhead, the aperture plate is wiped again while applying a second assist pressure to the ink in the printhead. The second assist pressure is different than the first assist pressure.

According to yet another embodiment, a method of performing printhead maintenance maximizes the low pressure assist by using the total pressure at the apertures as a means of controlling external particle contamination. In particular, a method of performing maintenance on a printhead of an imaging device includes the application of a purge pressure to ink in an on-board reservoir of a printhead to cause ink to be burped through a plurality of apertures in an aperture plate of the printhead. A wiper blade is then drawn across the aperture plate. An assist pressure is applied to the on-board reservoir during the wiping of the printhead to prevent ink from being pushed into the plurality of apertures by the wiper blade. The assist pressure is adjusted based on a level of ink in the on-board reservoir.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
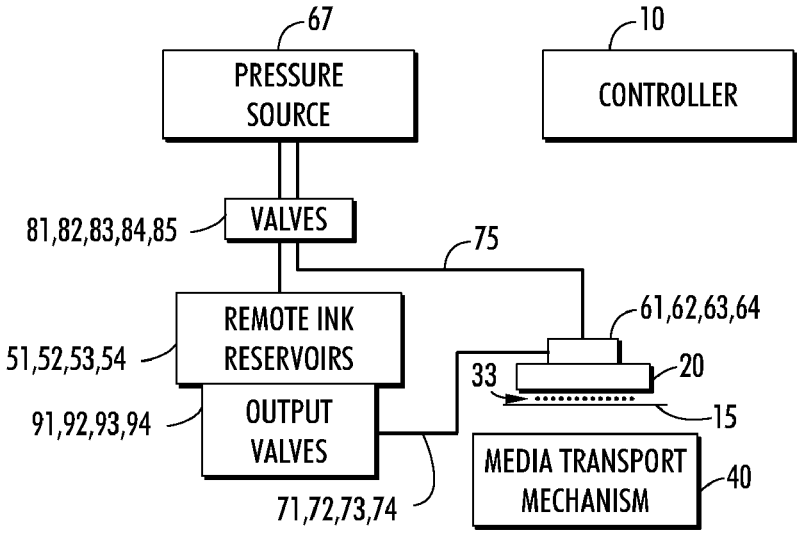
FIG. 1 is a schematic block diagram of an embodiment of an ink jet printing apparatus that includes on-board ink reservoirs.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Figure 2:
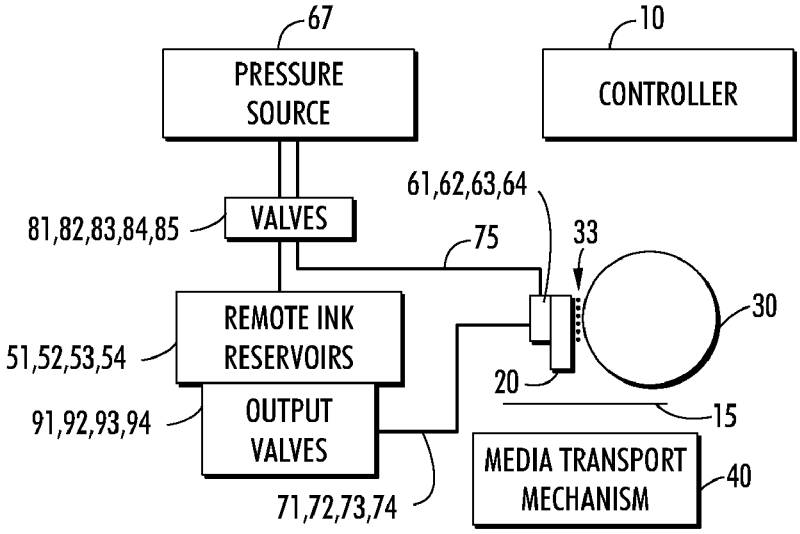
FIG. 2 is a schematic block diagram of another embodiment of an ink jet printing apparatus that includes on-board ink reservoirs.

FIGS. 1 and 2 are schematic block diagrams of an embodiment of an ink jet printing apparatus that includes a controller 10 and a printhead 20 that may include a plurality of drop emitting drop generators for emitting drops of ink 33 either directly onto a print output medium 15 or onto an intermediate transfer surface 30. A print output medium transport mechanism 40 may move the print output medium relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74.

Although not depicted in FIGS. 1 or 2, ink jet printing apparatus includes an ink delivery system for supplying ink to the remote ink containers 51-54. In one embodiment, the ink jet printing apparatus is a phase change ink imaging device. Accordingly, the ink delivery system comprises a phase change ink delivery system that has at least one source of at least one color of phase change ink in solid form. The phase change ink delivery system also includes a melting and control apparatus (not shown) for melting the solid form of the phase change ink into a liquid form and delivering the melted ink to the appropriate remote ink container.

The remote ink containers 51-54 are configured to communicate melted phase change ink held therein to the on-board ink reservoirs 61-64. In one embodiment, the remote ink containers 51-54 may be selectively pressurized, for example by compressed air that is provided by a source of compressed air 67 via a plurality of valves 81, 82, 83, 84. The flow of ink from the remote containers 51-54 to the on-board reservoirs 61-64 may be under pressure or by gravity, for example. Output valves 91, 92, 93, 94 may be provided to control the flow of ink to the on-board ink reservoirs 61-64.

The on-board ink reservoirs 61-64 may also be selectively pressurized, for example by selectively pressurizing the remote ink containers 51-54 and pressurizing an air channel 75 via a valve 85. Alternatively, the ink supply channels 71-74 may be closed, for example by closing the output valves 91-94, and the air channel 75 may be pressurized. The on-board ink reservoirs 61-64 may be pressurized to perform a cleaning or purging operation on the printhead 20, for example. The on-board ink reservoirs 61-64 and the remote ink containers 51-54 may be configured to contain melted solid ink and may be heated. The ink supply channels 71-74 and the air channel 75 may also be heated.

The on-board ink reservoirs 61-64 are vented to atmosphere during normal printing operation, for example by controlling the valve 85 to vent the air channel 75 to atmosphere. The on-board ink reservoirs 61-64 may also be vented to atmosphere during non-pressurizing transfer of ink from the remote ink containers 51-54 (i.e., when ink is transferred without pressurizing the on-board ink reservoirs 61-64).

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 engages an output print medium 15 against the transfer drum 30 to cause the image printed on the transfer drum to be transferred to the print output medium 15.

Figure 3:
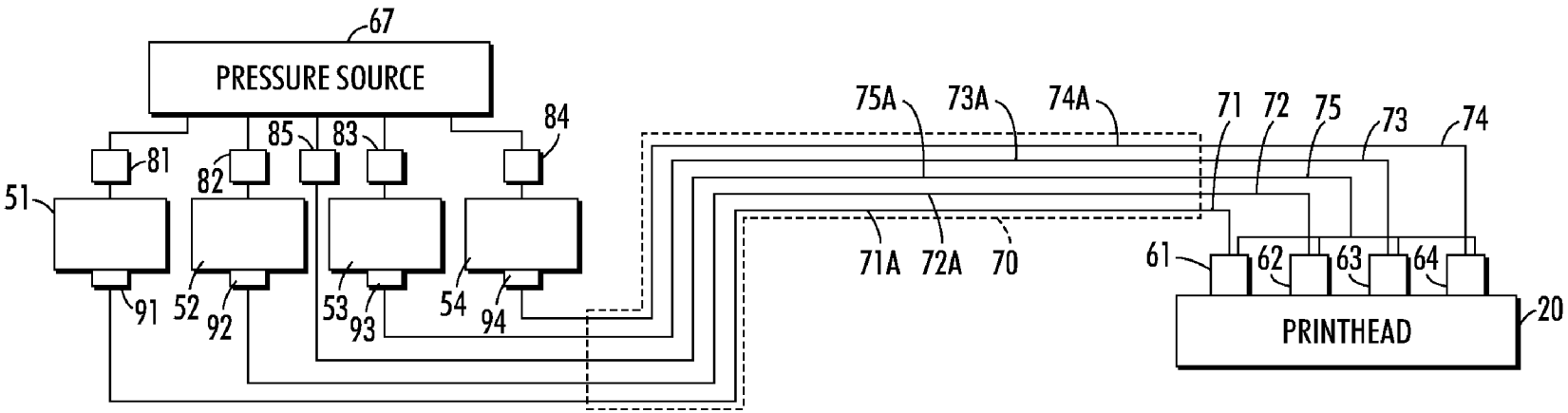
FIG. 3 is a schematic block diagram of an embodiment of ink delivery components of the ink jet printing apparatus of FIGS. 1 and 2.

As schematically depicted in FIG. 3, a portion of the ink supply channels 71-74 and the air channel 75 may be implemented as conduits 71A, 72A, 73A, 74A, 75A in a multi-conduit cable 70.

Figure 4:
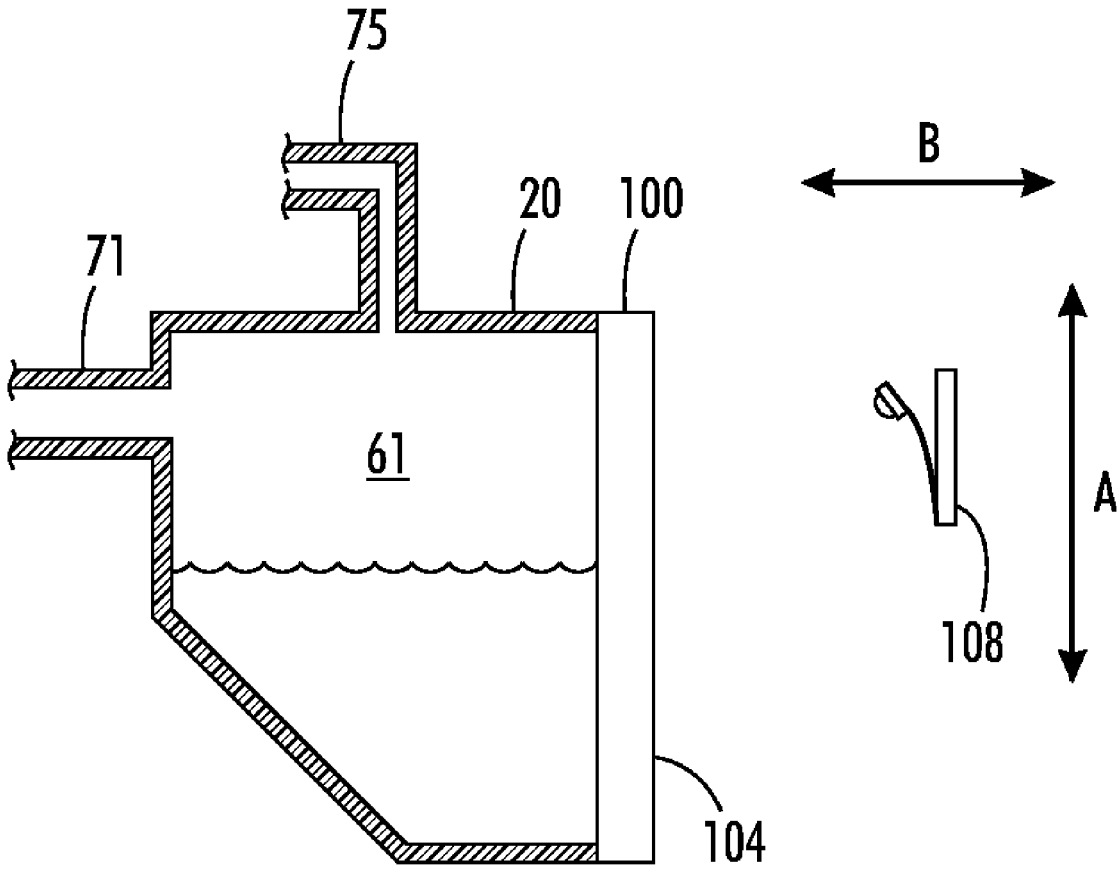
FIG. 4 is a simplified side cross-sectional view of an embodiment of a printhead of FIGS. 1-3.

Once pressurized ink reaches a printhead via an ink supply channel, it is collected in the on-board reservoir. The on-board reservoir is configured to communicate the ink to a jet stack 100 that includes a plurality of ink jets (not shown) for ejecting the ink onto a print medium (FIG. 1) or an intermediate transfer member such as transfer drum 30 (FIG. 2). FIG. 4 shows an embodiment of a printhead 20 including at least one on-board reservoir 61 and a jet stack 100. The jet stack 100 can be formed in many ways, but in this example, it is formed of multiple laminated sheets or plates, such as stainless steel plates. Cavities etched into each plate align to form channels and passageways (not shown) that define the ink jets for the printhead. An outer plate comprises the aperture plate 104 that includes a plurality of apertures (not shown) corresponding to each ink jet through which drops of ink are emitted. During operation, ink from the on-board printhead reservoir 61 fills the ink manifolds, inlet channels, pressure chambers, and outlet channels of the ink jets 108 and forms a meniscus (not shown) at each aperture prior to being expelled from the apertures in the form of a droplet. The meniscus of the melted ink is maintained at the apertures of the printhead and prevented from leaking or drooling from the apertures by providing a slightly negative pressure, i.e., back pressure, to the ink inside the reservoir. The back pressure is usually in the range of −0.5 to −5.0 inches of water. Any suitable method or device may be used to provide the slight negative pressure required to maintain the ink at the nozzles. For example, as is known in the art, the positioning of the on-board reservoirs with respect to the jetstack and the dimensioning of the ink chambers and passageways in the on-board reservoirs and jetstacks of the printhead may be selected to provide the required back pressure to pinning the ink menisci at the apertures and to prevent ink from drooling from the apertures.

One difficulty faced by fluid ink jet systems, such as those described above, is contamination in and around the apertures in the aperture plate resulting in partially or completely blocked ink jets. In order to recover from and/or prevent aperture contamination, imaging devices may include a maintenance system for periodically performing a maintenance procedure on the printhead(s). Maintenance procedures typically include purging ink through apertures of the printhead, also referred to as burping, and wiping the aperture plate to remove ink and debris from the surface of the aperture plate. In order to purge ink from the printhead of FIG. 4, a purge pressure may be applied to ink in the on-board printhead reservoir 61 using the pressure source (i.e., air pump) 67 through an opening, or vent, operably coupled to the air channel 75 (FIGS. 1-3). The introduction of the purge pressure into the on-board reservoir causes ink the reservoir to discharge through the apertures in the aperture plate 104. Purge pressures are typically a few to several psi, and, in one embodiment, is approximately 4.1 psi. After ink is purged through the apertures of the printhead, a scraper or wiper blade 108 may be drawn across the aperture plate 104 to squeegee away any excess liquid phase change ink, as well as any paper, dust or other debris that has collected on the aperture plate 104. The wiper blade and/or the printhead may include a positioning system (not shown) that enables the wiper blade and/or the printhead to be moved with respect to each to perform a wiping procedure. For example, in the embodiment of FIG. 4, either or both of the wiper and the printhead may be configured for movement so that the wiper blade 108 may be moved toward and away from the aperture plate 104 in the direction of arrow B and so that the wiper blade may be moved substantially parallel to the front surface of the aperture plate 104 in the direction of arrow A.

To prevent ink and debris from being pushed back into the printhead 50 via the apertures during wiping, the pressure source 67 may also be configured to deliver a low pressure assist (i.e., "LPA" or "assist") pressure to the on-board reservoir 61 of the printhead, which in an exemplary embodiment is about 0.04 psi, or about 1.1 to about 1.5 inches of water. Thus, the pressure source may be configured to deliver air under pressure to the on-board reservoir at a plurality of different pressure levels. The plurality of pressure levels may be provided by using a variable speed air pump and/or by controlling valve 85 to bleed off pressure from the pressure supplied by the air pump until a desired pressure level is reached.

The application of an assist pressure to the on-board reservoir during wiping may be effective in preventing contamination from entering a printhead and reduce color mixing, however, the surface wetting characteristics of the aperture plate and/or the internal pressure characteristics of the on-board reservoirs determine the amount of pressure before ink drools from the apertures during or after wiping. Also, changes in time can occur due to printhead age or use in which surface wetting characteristics and/or internal pressure characteristics of the printhead cause ink to drool from the apertures at a lower pressure relative to the pressure at which ink drooled from the apertures when initially manufactured. This can result in drooling at a lower pressure than that required for optimal particle mitigation or color mixing need needs. If the drool pressure of a printhead is lowered for whatever reason, the application of the normal assist pressure to the on-board reservoir may cause ink to drool from the apertures during wiping. Such drooling can negatively impact imaging operations by leaving ink on the aperture plate which may cause color mixing as well as further contamination of the apertures.

The surface characteristics of the apertures plate may change over time due to many factors including mechanical and chemical surface changes. This is caused by extended contact with ink and debris as well as other factors. For example, the surface characteristics of the apertures plate may change due to the repeated wiping of debris particles across the surface of the aperture plate by the wiper blade which may eventually damage or degrade the surface of the aperture plate, and, in particular, the anti-wetting properties of coatings, such as Teflon™, applied to the surface of the aperture plate. Such repeated wiping of debris particles by the wiper blade may also result in damage or degradation of the wiper blade. A damaged or worn wiper blade may not adequately clean or remove ink and debris from the aperture plate surface further exacerbating the problems of contamination entering the apertures of the aperture plate and drooling. All of these ultimately result in drooling at a pressure lower than that which is optimal for particle mitigation or color mixing needs.

Figure 5A:
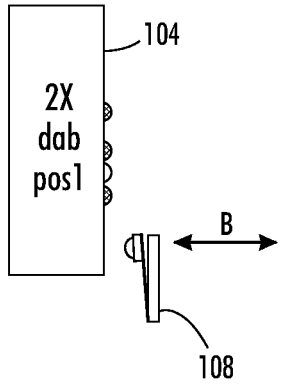
FIGS. 5*a*-5*c* schematically depict a prior art embodiment of a purge sequence.
Figure 5B:
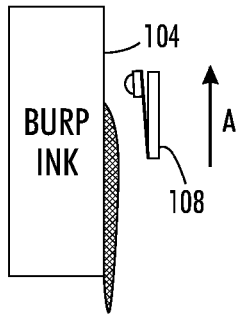
Figure 5C:
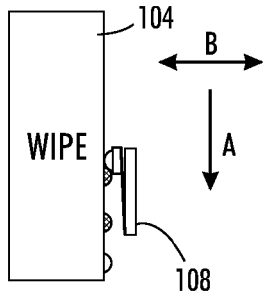

Aperture contamination as well as changes to the surface characteristics of the aperture plate over time that may cause drooling may be minimized or prevented by insuring that the aperture plate and the wiper blade are cleared of debris particles prior to performing a wipe of the aperture plate during a purge cycle. As mentioned above, the wiper is drawn across the aperture plate to clean ink and debris off the aperture plate. According to one aspect of the disclosure, the aperture plate may also be used to clean the wiper blade. This is accomplished by "dabbing" the wiper against the printhead at one or more positions away from the apertures such as at the bottom of the aperture plate beneath the apertures, referred to herein as dabbing positions. The "dab" process is meant to remove particles off the wiper. In some previously known systems, the wiper was dabbed against the aperture plate or another surface in an effort to remove particles from the wiper blade prior to purging or burping ink from the apertures and subsequently wiping the aperture plate. For example, FIGS. 5*a*-5*c* schematically show a prior art embodiment of a purge routine that involves dabbing the wiper against the aperture plate (FIG. 5*a*) prior to performing the burping (FIG. 5*b*) and wiping portions (FIG. 5*c*) of a purge cycle. Dabbing the wiper against the aperture plate prior to a purge may result in the wiper being dabbed against a dirty aperture plate and picking up contamination particles as a result.

To increase the effectiveness of dabbing the wiper blade against the aperture plate, the present disclosure proposes the use of a pre-burp in the purge sequence prior to dabbing the aperture plate with the wiper blade. The pre-burp may be performed by introducing a purge pressure into the reservoir 61 (FIG. 4) of the printhead for a predetermined duration that causes ink to be emitted from the apertures of the aperture plate, such as by activating air pump and controlling valve 85. The use of a pre-burp in a purge sequence is a simple and yet effective concept for reducing external contamination. The pre-burp cleans ink off the aperture plate 104 so that there is a clean surface on the aperture plate 104 against which the wiper blade may be dabbed prior to a wipe. There is also less chance of debris particles entering the apertures during the wipe.

Figure 6A:
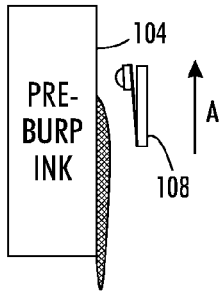
FIGS. 6*a*-6*d* schematically depict an embodiment of a purge sequence that utilizes pre-burps, pre-dabs and post-dabs.
Figure 6B:
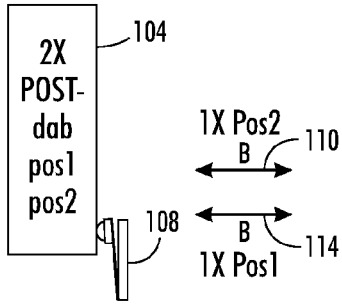
Figure 6C:
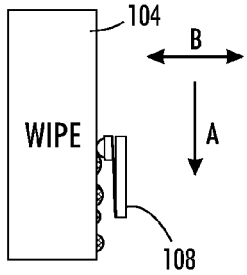

FIGS. 6*a*-6*d* schematically show an embodiment of a maintenance method that incorporates a pre-burp into a purge sequence prior to dabbing the wiper against the aperture plate. As seen in FIGS. 6*a*-6*d*, once ink has been purged from the apertures of the aperture plate 104 during the pre-burp (FIG. 6*a*), the wiper blade 108 may be dabbed against the aperture plate at least once (FIG. 6*b*) to remove contamination and debris from the wiper blade prior to performing a wipe of the aperture plate (FIG. 6*c*). Dabbing the wiper against the aperture plate prior to the wiping procedure, also referred to as a pre-dab, may be performed any suitable number of times. In the embodiment of FIG. 6*b*, the wiper 108 is dabbed against the aperture plate twice before the wiping procedure with each dab being performed at a different dabbing position 110, 114 on the aperture plate. As mentioned above, dabbing positions 110, 114 may be at a lower portion of the aperture plate 104 below the apertures (not shown). Dabbing the aperture plate 104 at different locations prevents the wiper 108 from picking up debris from the aperture plate that was just removed from the wiper blade in the previous dab.

Figure 6D:
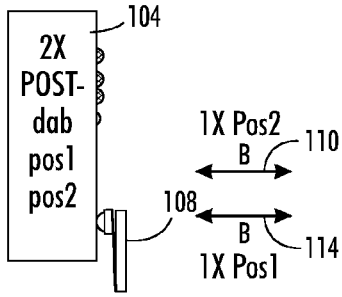

Once the pre-dabs have been performed, the aperture plate 104 may be wiped by the wiper blade 108 by moving wiper against the aperture plate 104 in the direction of arrow B and then drawing the wiper across the surface of the aperture plate in the direction of arrow A (FIG. 6*c*). As mentioned above, the pressure source 67 is configured to deliver an assist pressure to the on-board reservoir 61 of the printhead to prevent ink and debris from being pushed back into the apertures during wiping. The present disclosure also proposes the incorporation of at least one dabbing procedure into a purge sequence after the wiping procedure has been performed and before a pre-burp is performed in a subsequent purge sequence, referred to herein as a post-dab (FIG. 6*d*). Similar to pre-dabs, post-dabs may be performed any suitable number of times. In the embodiment of FIG. 5*d*, the wiper is post-dabbed against the aperture plate twice with each post-dab being performed at a different dabbing position 110, 114 on the aperture plate 104.

To determine the effectiveness of using a pre-burps, pre-dabs, and post-dabs in a purge sequence relative to the prior art sequence of dabbing prior to purging and wiping, a measurement system was developed that involved applying a fixed amount of cotton flocking to a printhead to create blocked ink jets. The cotton flocking has a very similar size distribution compared to paper dust. The number of blocked ink jets created in the printhead was then detected by printing test patterns and scanning the test pattern with an image sensor. Any previously defective ink jets were taken into account during the testing. The purge sequences schematically depicted in FIGS. 5*a*-5*c* and 6*a*-6*d*, respectively, were then each performed on the printheads to determine the number of blocked jets that were recovered by the respective purge sequences. Multiple such tests were performed of each purge sequence using multiple assist pressure levels, e.g., 0%, 20%, 40%, 60%, 80%, and 100% assist pressure, to determine the effectiveness of the respective maintenance strategies in recovering the blocked jets.

Figures 7, 8:
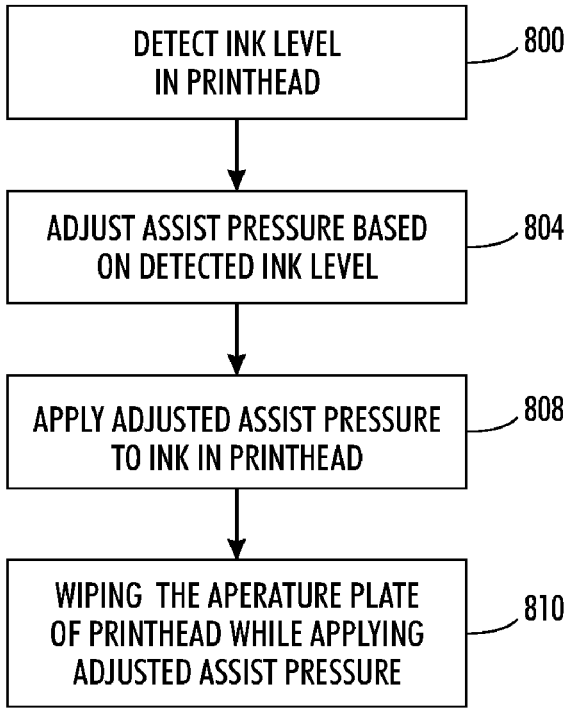
FIG. 7 is a chart of the effectiveness of the purge sequences from FIGS. 5*a*-5*c* and FIGS. 6*a*-6*d*.
FIG. 8 is a flowchart of a method of applying an assist pressure to ink in a printhead.

According to the tests, higher assist pressures during wiping are more effective at reducing blocked jets as compared to lower assist pressures. The data also showed that the use of both pre and post dabs also reduce defective jets and the combination of the both can be additive, especially at lower assist pressures. FIG. 7 is a chart that shows the reduction of defective jet recovery effectiveness (negative percentage) or the increase in defective jet recovery effectiveness (positive percentage) based on the testing. As seen in the chart, any reduction of assist pressure decreases the effectiveness of defective jet recovery. Also, the pre-burp and dabs can reduce the need for an assist pressure. Even for high assist pressure, e.g., assist pressure 100, the purge sequence of FIGS. 6*a*-6*d* that utilizes pre-burps and pre- and post-dabs was better at defective jet recovery by 4%. Also, the dabs do not result in any drooling and thus allow for jet recovery without risk to drooling.

The assist pressure applied to the printhead reservoir 61 during wiping is configured to maintain ink menisci at the apertures to prevent ink and debris from being pushed into the apertures. To maintain the ink at the apertures, the assist pressure must be sufficient to overcome the back pressure (e.g., −0.5 in H2O). If the assist pressure is too low (e.g., below 0.5 in H2O), ink and debris may be drawn into the apertures. Conversely, if the assist pressure is too high (e.g., greater than 0.5 in H2O), the apertures may drool ink even after a wipe has been performed. Maintaining the ink at the apertures during a wiping procedure is made more difficult by a varying pressure introduced into the reservoir due to changes in the amount of ink in the reservoir, also referred to as head height. The assist pressure and the head height both serve to apply pressure to the apertures during the wipe. However, the pressure from the ink height is not constant since it changes as the ink level changes.

The present disclosure proposes the use of an assist pressure during a wipe procedure that may be adjusted based on a level of ink in the on-board reservoir, or head height. Adjusting the assist pressure based on head height enables the maximum amount of pressure to be applied to the apertures without causing ink to drool from the apertures when the head height is high or letting ink to be drawn into the apertures when the head height is low. For example, in one embodiment, the maximum pressure to be applied to the apertures during a wipe is approximately 0.5 in H2O to negate the inherent back pressure of the printhead.

FIG. 8 depicts a flowchart of a method of applying an assist pressure to ink in a printhead during a wiping procedure. As depicted in FIG. 8, the amount of ink (e.g., head height) in a reservoir of a printhead is detected (block 800). The head height in the printhead reservoir 61 may be detected in any suitable manner. For example, the detected head height may be the actual head height detected using sensors (not shown) associated with the printhead reservoir 61. Alternatively, the head height may be an estimation of the amount of ink the reservoir that is calculated by tracking the amount of ink entering the printhead and leaving the printhead during printing and maintenance operations. The flow rates of ink into and out of the printhead are known so that a substantially accurate estimation of the head height may be determined. Once the head height has been detected, the assist pressure applied to the printhead reservoir may be adjusted (block 804). Once the assist pressure is adjusted, the adjusted assist pressure is applied to the ink in the printhead (block 808) prior to performing a wipe of the aperture plate. Once the adjusted assist pressure is applied, the aperture plate may be wiped while maintaining the adjusted assist pressure on the ink in the printhead (block 810).

In one embodiment, the assist pressure may be adjusted to a first level in response to the on-board reservoir being approximately full of ink. When the head height is full, the pressure applied to the apertures by the head height alone may be enough to prevent ink from being pushed into the apertures during a wipe procedure, e.g., may be approximately 0.5 in H2O. Therefore, in one embodiment, the first level corresponds to a minimum assist pressure which may be approximately 0.0 in H2O. The assist pressure may be adjusted to a second level in response to the on-board reservoir having a pre-defined low level of ink. When the head height is low, the pressure applied to the apertures by the head height may be insignificant compared to the assist pressure. Accordingly, in one embodiment, the second level corresponds to a maximum assist pressure that may be applied to the apertures to prevent ink from being pushed into the apertures during a wipe and ink from drooling out of the apertures without regard to head height. For example, as explained above, the assist pressure may be 1.1 to about 1.5 in H2O although the maximum assist pressure may be any suitable level of pressure. In either of the above cases (high or low head height), the resulting pressure seen at the apertures may end up being approximately 0.5 in H2O. The adjusted assist pressure may be determined in any suitable manner from the detected head height. For example, there may be a linear relationship between the detected head height and the adjusted assist pressure that may be utilized although not necessarily.

Figure 9:
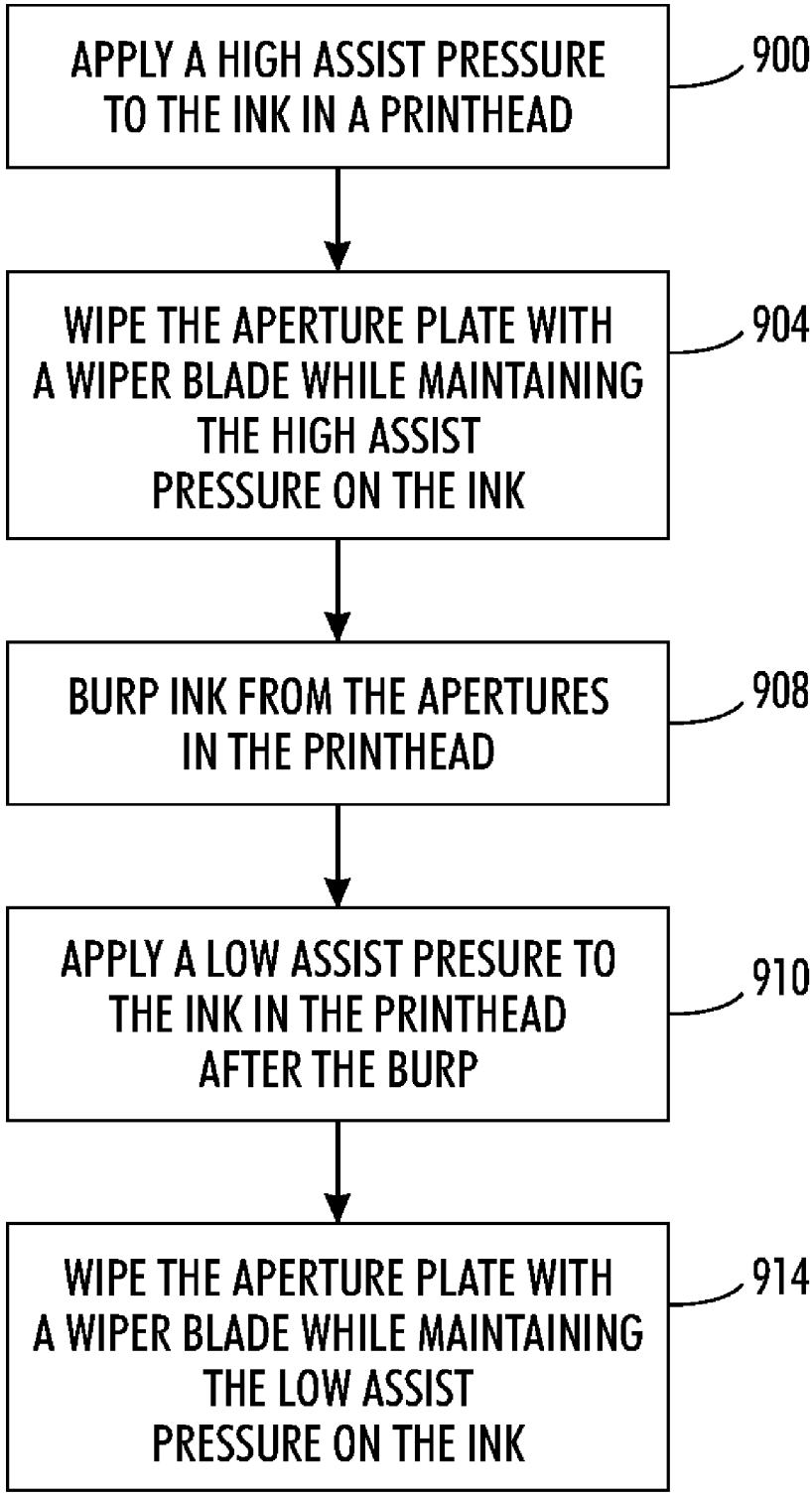
FIG. 9 is a flowchart of an embodiment of a maintenance sequence that utilizes high pressure assist wipes and low pressure assist wipes.

Another concept proposed by the present disclosure is the use of combinations of different pressure wipes and burps such as a higher LPA pre-wipe followed by a burp and a low pressure wipe, or a burp with a high pressure pre-wipe followed by a low pressure wipe. The concepts are done to maximize the pressure applied to the apertures to clean the faceplate and increase jet recovery performance but still mitigate the impacts of drooling. For example, FIGS. 9 and 10 each show a flowchart of an embodiment of a maintenance method that combines a burp with a higher assist pressure wipe followed by a lower assist pressure wipe. In FIG. 9, a pre-wipe is shown. The method begins with the application of a high assist pressure to the ink in a printhead (block 900) followed by a wiping the aperture plate with a wiper blade while maintaining the high assist pressure to ink in the printhead (block 904). In one embodiment, the high assist pressure is configured to cause ink to be drooled from the apertures during and after the wipe. Accordingly, the high assist pressure may correspond to the purge pressure (except that is being applied during the wipe). The drooling of ink resulting from the high assist pressure helps to remove debris particles from the aperture plate. After the high assist pressure wipe is performed, a burp can be performed (if needed to further remove air bubbles and/or contaminates) (block 908) and is finally followed by a lower assist pressure wipe (blocks 910 and 914) to remove any drooled ink from the aperture plate. This $2^{nd}$ wipe can be performed at a lower assist pressure because the initial high assist pressure wipe removed the particles from the aperture plate. The low assist pressure may be any suitable pressure, and, in one embodiment is approximately 0(zero) in H2O.

Figure 10:
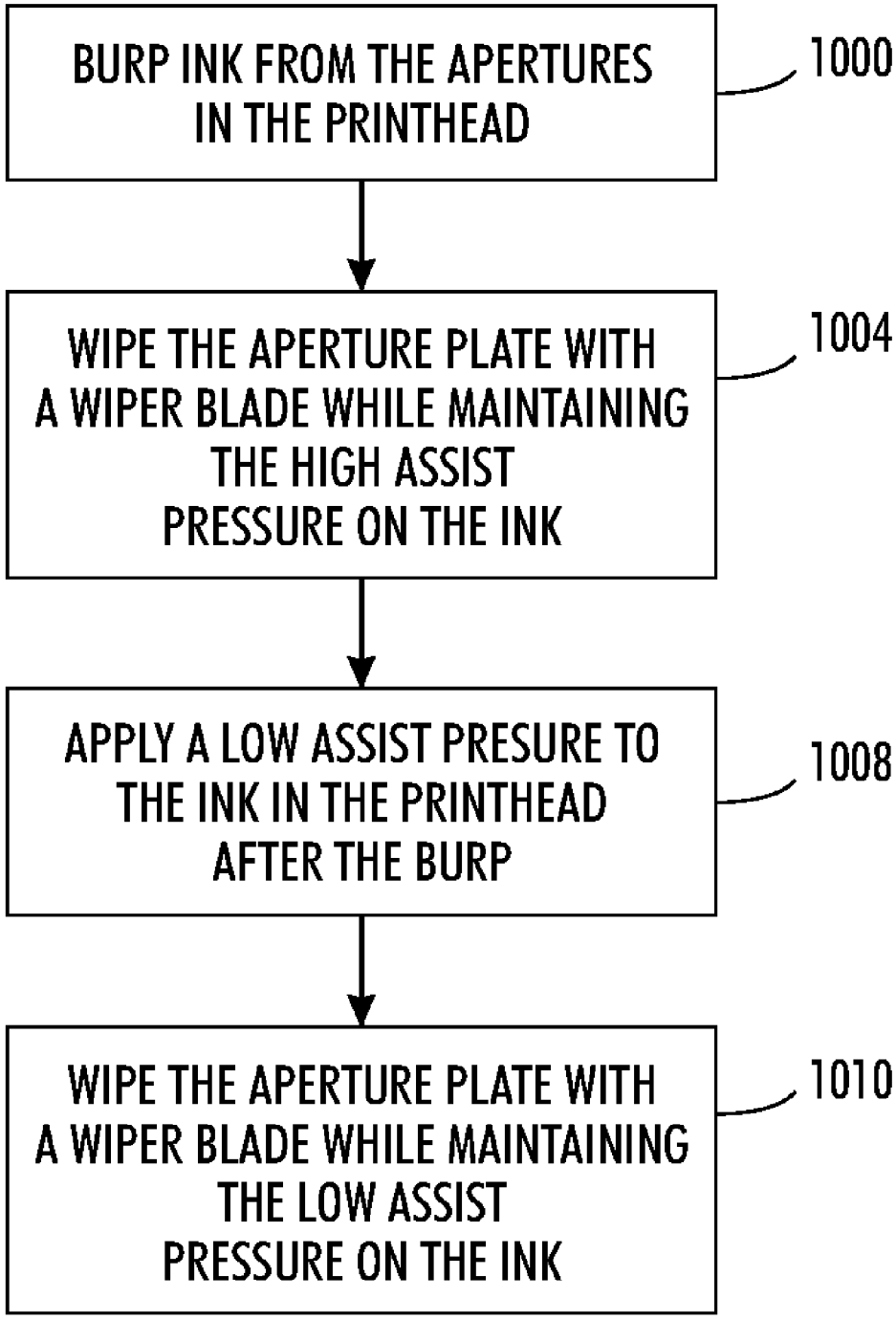
FIG. 10 is a flowchart of another embodiment of a maintenance sequence that utilizes high pressure assist wipes and low pressure assist wipes.

Referring now to FIG. 10, a maintenance method that utilizes an initial burp followed by a high assist pressure wipe and then followed by a low assist pressure wipe is depicted. The method begins with the burping of ink from the apertures of the printhead by applying a high pressure (e.g., a purge pressure) to the ink in the printhead which causes an ink burp to remove air bubbles and/or contaminates from the aperture plate (block 1000). The aperture plate may then be wiped while maintaining a high assist pressure on the ink in the printhead (block 1004). In one embodiment, the high assist pressure is configured to cause ink to be drooled from the apertures during and after the wipe. Accordingly, the high assist pressure may correspond to the purge pressure (except that is being applied during the wipe). The drooling of ink resulting from the high assist pressure helps to remove debris particles from the aperture plate. After the high assist pressure wipe is performed, a low assist pressure wipe is performed (blocks 1008 and 1010) to remove any remaining ink from aperture plate from the initially high assist pressure wipe. The low assist pressure may be any suitable pressure, and, in one embodiment is approximately 0(zero) in H2O. FIG. 10 shows the use of a high LPA purge followed by a 0 LPA wipe. The idea is that the initial high LPA purge will eliminate any particle from the jetstack. Of course, the apertures of the printhead may drool ink at the higher pressure and there is ink left on the faceplate after the purge. However, since the particles are all removed, a low assist pressure wipe may then be capable of removing any ink from the faceplate prior to printing. Although not depicted or mentioned in relation to FIGS. 9 and 10, predabs and postdabs of the wiper may be performed to ensure that the wiper is clean prior to performing a wipe.

Burps, dabs, low and high assist pressure wipes may be used in a number of different sequences and combinations in addition to those described above. For example, one embodiment of a maintenance sequence includes the following sequence: 1) a first burp of ink through the apertures of printhead, 2) a first high assist pressure wipe of the faceplate of the printhead, 3) a second burp of ink through the apertures, 4) a high LPA wipe of the face plate, and 5) then a low assist pressure wipe of the faceplate. Another example of a maintenance sequence that may be utilized includes: 1) a first high assist pressure wipe, 2) then a burp of ink through the apertures, 3) a second high assist pressure wipe, and 4) then a low assist pressure wipe of the faceplate. Substantially any combination of burps, dabs, and wipes at multiple assist pressures may be utilized.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of performing maintenance on a printhead of an imaging device, the method comprising:

applying a purge pressure to ink in an on-board reservoir of a printhead to cause ink to be burped through a plurality of apertures in an aperture plate of the printhead;

dabbing a wiper blade on the aperture plate at a dabbing position at least once prior to wiping and after the application of the purge pressure;

wiping the wiper blade at least across the plurality of apertures in the aperture plate after the dabbing of the wiper blade at the dabbing position;

applying an assist pressure to the on-board reservoir during the wiping of the aperture plate to prevent ink from being pushed into the plurality of apertures by the wiper blade, the assist pressure being applied at a first level in response to the on-board reservoir being approximately full of ink and the assist pressure being applied at a second level in response to the on-board reservoir having a low level of ink, the second level being greater than the first level; and dabbing the wiper blade at the dabbing position at least once after the wiper blade wipes the aperture plate.

2. The method of claim 1, the first level corresponding to a minimum assist pressure, and the second level corresponding to a maximum assist pressure.

3. The method of claim 1 further comprising:

the dabbing of the wiper blade at least once prior to the wiper blade wiping the aperture plate and the dabbing of the wiper blade at least once after the wiper blade wipes the aperture plate are each performed twice.

4. A method of performing maintenance on a printhead of an imaging device, the method comprising:

wiping an aperture plate of a printhead with a wiper blade while applying a first assist pressure to ink in the printhead;

after wiping the printhead, purging ink through a plurality of apertures in the aperture plate of the printhead;

after purging the printhead, wiping the aperture plate of the printhead with the wiper blade while applying a second assist pressure to the ink in the printhead, the second assist pressure being less than the first assist pressure.

5. The method of claim 4 further comprising:

after the purge and prior to the wipe at the second assist pressure, wiping the aperture plate of the printhead with the wiper blade while applying the first assist pressure to the ink in the printhead.

6. A method of performing maintenance on a printhead of an imaging device, the method comprising:

applying a purge pressure to ink in a printhead, the purge pressure being configured to cause ink to be purged from a plurality of apertures in an aperture plate of the printhead;

after purging the printhead, wiping the aperture plate of the printhead with a wiper blade while applying a first assist pressure to the ink in the printhead; and after wiping the printhead, wiping the aperture plate again while applying a second assist pressure to the ink in the printhead, the second assist pressure being less than the first assist pressure.

7. The method of claim 6 further comprising:

prior to the application of the purge pressure, wiping the aperture plate with a wiper blade while applying the first assist pressure to the ink in the printhead.

8. A method of performing maintenance on a printhead of an imaging device, the method comprising:

applying a purge pressure to ink in an on-board reservoir of a printhead to cause ink to be burped through a plurality of apertures in an aperture plate of the printhead;

wiping the wiper blade at least across the plurality of apertures in the aperture plate;

applying an assist pressure to the on-board reservoir during the wiping of the printhead with the wiper blade to prevent ink from being pushed into the plurality of apertures by the wiper blade, the assist pressure being applied at a first level in response to the on-board reservoir being approximately full of ink and the assist pressure being applied to a second level in response to the on-board reservoir having a low level of ink, the second level being greater than the first level.

9. The method of claim 8, the first level corresponding to a minimum assist pressure, and the second level corresponding to a maximum assist pressure.

10. The method of claim 8, further comprising:

dabbing a wiper blade on the aperture plate at a dabbing position at least once after the application of the purge pressure and prior to the wiper blade wiping the aperture plate.

11. The method of claim 10, further comprising:

dabbing the wiper blade at the dabbing position at least once after the wiper blade wipes the aperture plate.

12. The method of claim 11, the dabbing of the wiper blade prior to the wiper blade wiping the aperture plate and the dabbing of the wiper blade after the wiper blade wipes the aperture plate are each performed twice.

* * * * *